US011473414B2

(12) United States Patent
Qu

(10) Patent No.: US 11,473,414 B2
(45) Date of Patent: Oct. 18, 2022

(54) METHOD AND DEVICE FOR CONDUCTING EXPLOSIVE-FRACTURING

(71) Applicant: Bo Qu, Vaughan (CA)

(72) Inventor: Bo Qu, Vaughan (CA)

( * ) Notice: Subject to any disclaimer, the term of this patent is extended or adjusted under 35 U.S.C. 154(b) by 98 days.

(21) Appl. No.: 17/164,017

(22) Filed: Feb. 1, 2021

(65) Prior Publication Data

US 2021/0254443 A1 Aug. 19, 2021

Related U.S. Application Data

(63) Continuation-in-part of application No. 17/099,207, filed on Nov. 16, 2020, now abandoned, which is a continuation of application No. 16/382,048, filed on Apr. 11, 2019, now Pat. No. 10,837,271.

(60) Provisional application No. 62/677,308, filed on May 29, 2018.

(51) Int. Cl.

| | |
|---|---|
| ***E21B 33/128*** | (2006.01) |
| ***E21B 23/04*** | (2006.01) |
| ***E21B 23/06*** | (2006.01) |
| ***E21B 43/263*** | (2006.01) |
| ***E21B 34/10*** | (2006.01) |

(52) U.S. Cl.

CPC ..... *E21B 43/263* (2013.01); *E21B 34/10* (2013.01)

(58) Field of Classification Search

CPC ..... E21B 33/124; E21B 33/128; E21B 23/04; E21B 23/0411; E21B 23/0412; E21B 23/0414; E21B 23/0421; E21B 23/0416; E21B 23/06; E21B 23/065

See application file for complete search history.

(56) References Cited

U.S. PATENT DOCUMENTS

| | | | | |
|---|---|---|---|---|
| 3,029,732 | A * | 4/1962 | Greene | E21B 43/11 102/319 |
| 3,075,463 | A | 1/1963 | Eilers et al. | |
| 3,174,545 | A | 3/1965 | Mohaupt | |
| 3,422,760 | A | 1/1969 | Mohaupt | |
| 3,948,176 | A * | 4/1976 | Koomen | E21B 43/263 166/299 |
| 5,111,746 | A | 5/1992 | Pentel et al. | |
| 6,053,247 | A | 4/2000 | Wesson et al. | |
| 8,950,505 | B2 * | 2/2015 | Themig | E21B 33/1285 166/120 |
| 10,837,271 | B2 * | 11/2020 | Qu | E21B 34/10 |

(Continued)

*Primary Examiner* — Kenneth L Thompson

(74) *Attorney, Agent, or Firm* — Novick, Kim & Lee, PLLC; Allen Xue

(57) ABSTRACT

A downhole sub has a cylindrical body and a sealing device disposed about the cylindrical body. The cylindrical body has a first fluid chamber configured to store a hydraulic fluid, a second fluid chamber configured to store a liquid energetic material, a piston slidably disposed between the first fluid chamber and the second fluid chamber, and an ignition unit. The sealing device has two annular pistons and two annular sealing rings. The sub is loaded with the liquid energetic material and lowered into a well casing installed in the subterranean formation. A section of the well casing having a plurality of perforations is sealed. The liquid energetic material in the downhole sub is injected into the subterranean formation through the plurality of perforations in the well casing and is detonated using the ignition unit in the downhole sub.

20 Claims, 13 Drawing Sheets

(56) References Cited

U.S. PATENT DOCUMENTS

| | | | | |
|---|---|---|---|---|
| 2005/0109509 | A1 | 5/2005 | Snider et al. | |
| 2009/0316455 | A1 | 12/2009 | Kim et al. | |
| 2015/0354304 | A1* | 12/2015 | Wood | E21B 23/06 166/302 |
| 2021/0262302 | A1* | 8/2021 | Flores Perez | E21B 33/1293 |

* cited by examiner

B

C

C1

E

METHOD AND DEVICE FOR CONDUCTING EXPLOSIVE-FRACTURING

CROSS-REFERENCE TO RELATED APPLICATIONS

The present application claims the benefit of and is a continuation-in-part of U.S. patent application Ser. No. 17/099,207, filed Nov. 16, 2020, which is a continuation of U.S. patent application Ser. No. 16/382,048, filed Apr. 11, 2019, entitled "METHOD AND DEVICE FOR CONDUCTING EXPLOSIVE-FRACTURING," issued as U.S. Pat. No. 10,837,271 on Nov. 17, 2020, which claims priority to U.S. provisional patent application Ser. No. 62/677,308, filed May 29, 2018.

FIELD OF TECHNOLOGY

This disclosure relates to methods and devices for oil and gas exploration, more particularly relates to methods and devices for injecting a liquid energetic material into formations and igniting the liquid energetic material in situ for formation fracturing.

BACKGROUND

Hydraulic fracturing is an important technique in oil and gas well completion for high-density, low-permeability conventional reservoirs, as well as for unconventional shale reservoirs. However, the cost of hydraulic fracturing may account for more than one half of the total oil and gas well completion expenses. In addition, conventional hydraulic fracturing consumes a large amount of water, causing environmental issues and social controversy. Also, accessing oil and gas fields located in complex terrains is very challenging. In-layer explosive fracturing technology provides an alternative to hydraulic fracturing. However, explosive fracturing requires more precise control to ensure safety and effectiveness. The current disclosure provides methods and devices that meet such needs, such as injecting and detonating liquid energetic material in subterranean formations.

SUMMARY

A downhole sub for oil or gas exploration includes a cylindrical body and a sealing device disposed about the cylindrical body. The cylindrical body has a first fluid chamber configured to store a hydraulic fluid, a second fluid chamber configured to store a liquid energetic material, e,g., a liquid energetic material, a liquid propellant, or a liquid fuel, a piston slidably disposed between the first fluid chamber and the second fluid chamber, and an ignition unit adjacent to the second fluid chamber. The sealing device comprises a first annular piston, a first annular sealing ring, a second annular sealing ring, and a second annular piston arranged in tandem along an axial direction of the cylindrical body.

In one embodiment of the disclosure, the second fluid chamber is fluidly connected to the first annular piston and the third fluid chamber is fluidly connected to the second annular piston.

In one aspect of the current disclosure, the first annular sealing ring and the second annular sealing ring are expandable in a radial direction of the downhole sub.

In some embodiments, the ignition unit is a percussion firing unit having a firing pin, a firing head and an ignition source. In other embodiments, the ignition unit is an electric ignition unit having an electric detonator and a power source.

In some of the embodiments, during operation, the piston exerts a pressure on the liquid energetic material in the second fluid chamber, and causes the pressurized liquid energetic material to push the first annular piston toward the first annular sealing ring and to push the second annular piston toward the second annular sealing ring, whereby causing the first annular sealing ring and the second annular sealing ring to expand radially.

In other embodiments, the cylindrical body has one or more stopping mechanisms disposed between the first annular sealing ring and the second annular sealing ring. The stopping mechanism is a protrusion extending radially from a surface of the cylindrical body.

In certain embodiments, the downhole sub has a sleeve having one or more orifices or channels fluidly connected to the second fluid chamber. The sleeve is disposed about the cylindrical body. The sleeve can be made of metal, rubber, or a solid propellant.

In still other embodiments, the piston is connected to a rod configured to move with the piston and to stop after coming into contact with the ignition unit. In some cases, the ignition unit is activated by the rod.

Some embodiments further contain an annular coupling disposed between the second fluid chamber and the first annular piston. The coupling houses a spring-loaded check valve having an inlet opening to the second fluid chamber and an outlet opening toward the first annular piston.

Still some embodiments contain a pressure relief device disposed about the coupling. The pressure relief device has an inlet opening toward the first annular piston and an outlet opening toward a gap in the cylindrical body.

An exemplary method for injecting and detonating a liquid energetic material in a subterranean formation includes the steps of loading a liquid energetic into the downhole sub; lowering the downhole sub into a well casing installed in the subterranean formation; sealing a section of the well casing having a plurality of perforations using the sealing device of the downhole sub; injecting the liquid energetic material in the downhole sub into the subterranean formation through the plurality of perforations in the well casing; and detonating the liquid energetic material in the subterranean formation using the ignition unit in the downhole sub.

In some of the methods, the sealing step further includes hydraulically pressurizing the liquid energetic material in the second fluid chamber; hydraulically pushing the first annular piston toward the first annular sealing ring, hydraulically pushing the second annular piston toward the second annular sealing ring, wherein the compressed first annular sealing ring and the compressed second annular sealing ring expand in a radial direction of the downhole sub toward an inner surface of the well casing.

In other methods, the injecting step further includes opening one or more channels connecting the second fluid chamber to one or more openings on the surface of the downhole sub aligned with the sealed section of the well casing.

In still other methods, the ignition unit in the downhole sub has a percussion firing pin and a firing head. The ignition step includes hydraulically pushing the piston toward the ignition unit and contacting the ignition unit by the piston or an extension thereof, thereby dislodging the percussion firing pin to collide with the firing head to ignite. Alternatively, the ignition unit is an electric ignition unit having an electric detonator and a power source. The detonating step includes hydraulically pushing the piston toward the ignition unit; contacting the ignition unit with the piston or an extension thereof, and electrically connecting the electric detonator and the power source to ignite the electric detonator.

Some of the methods include a step of decompressing the downhole sub so that the first annular sealing ring and the second sealing ring can be disengaged from the well casing so that the downhole sub can be retrieved from the well casing. Decompression can be accomplished by pushing a pressure relief device using the piston or an extension thereof to open a fluid passage between the well casing and the first annular piston.

BRIEF DESCRIPTIONS OF THE DRAWINGS

These and other features, aspects, and advantages of the present invention will become better understood by reference to the accompanying drawings.

Figure 1:
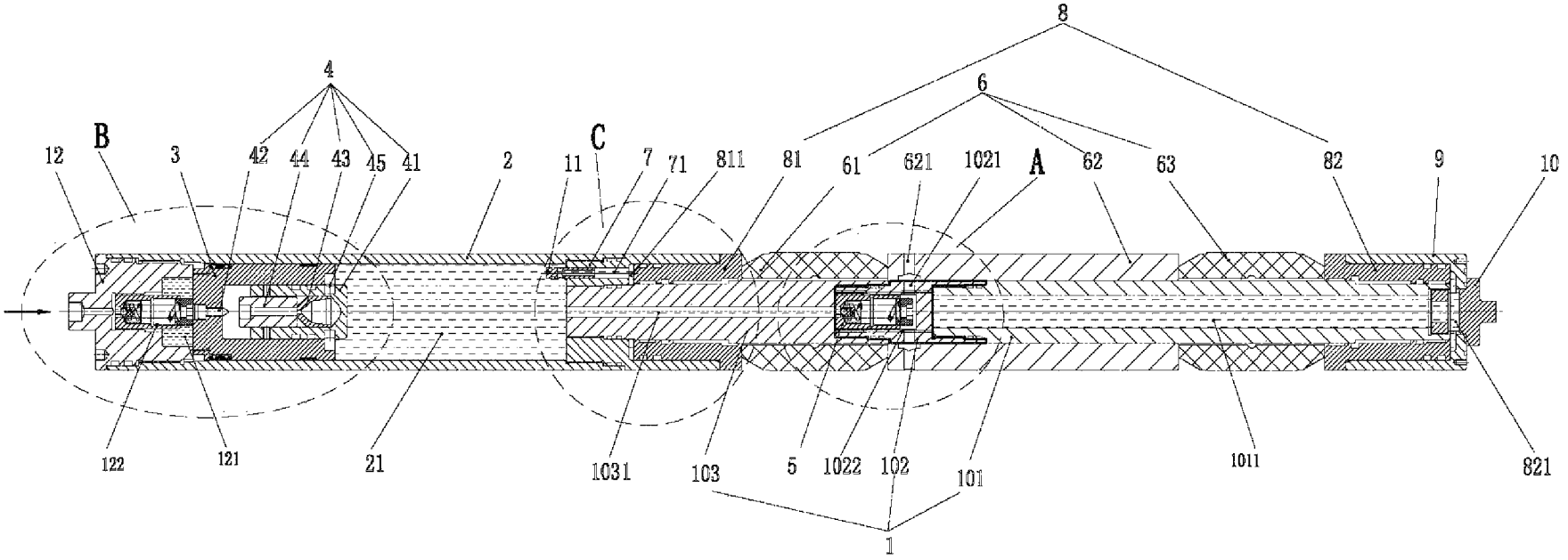
FIG. 1 shows a first embodiment of the liquid injection and detonation downhole sub in the current disclosure.
Figure 6:
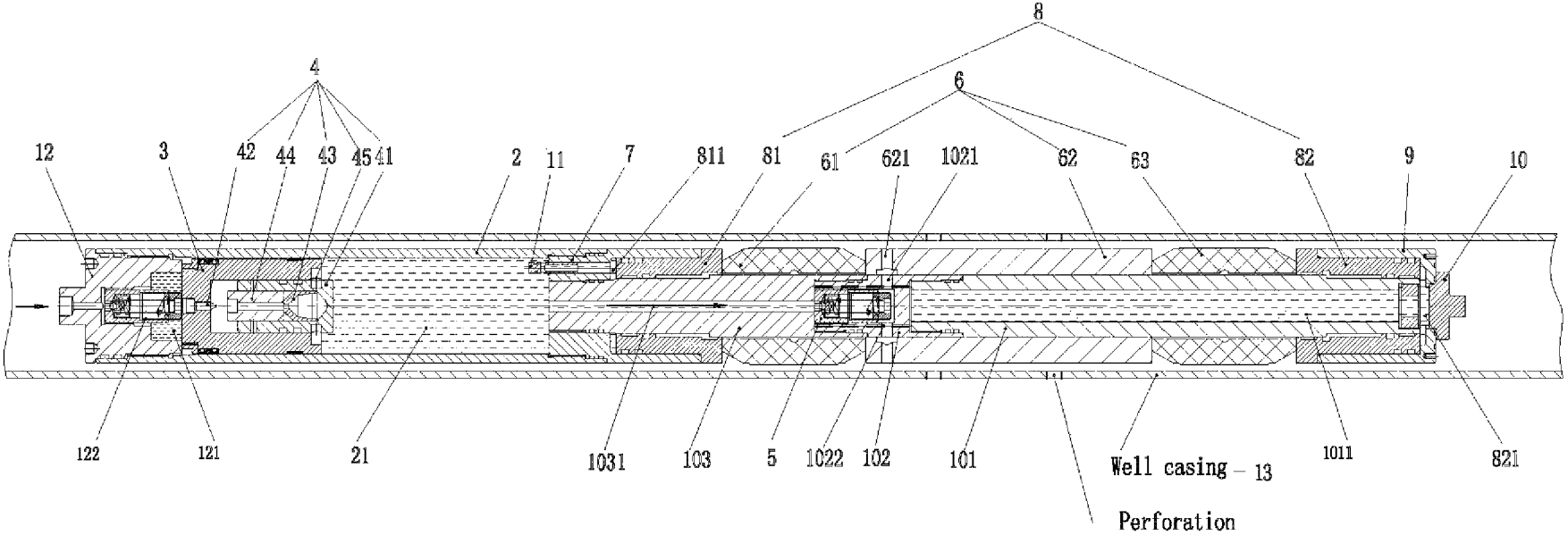
Figure 7:
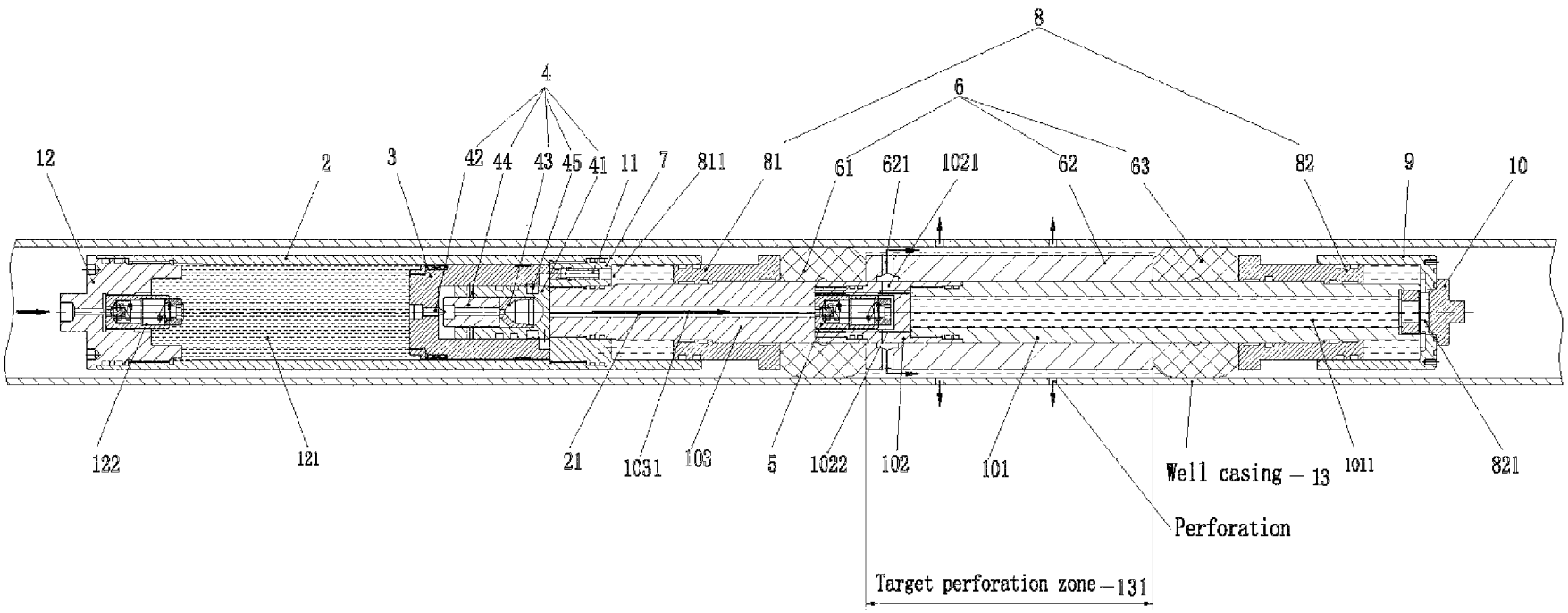

FIG. 6 presents the downhole sub of FIG. 1 filled with a liquid energetic material, deployed in a well casing;

FIG. 7 presents the status of the downhole sub of FIG. 1 after most of the liquid energetic material has been injected into the formation.

Figure 8:
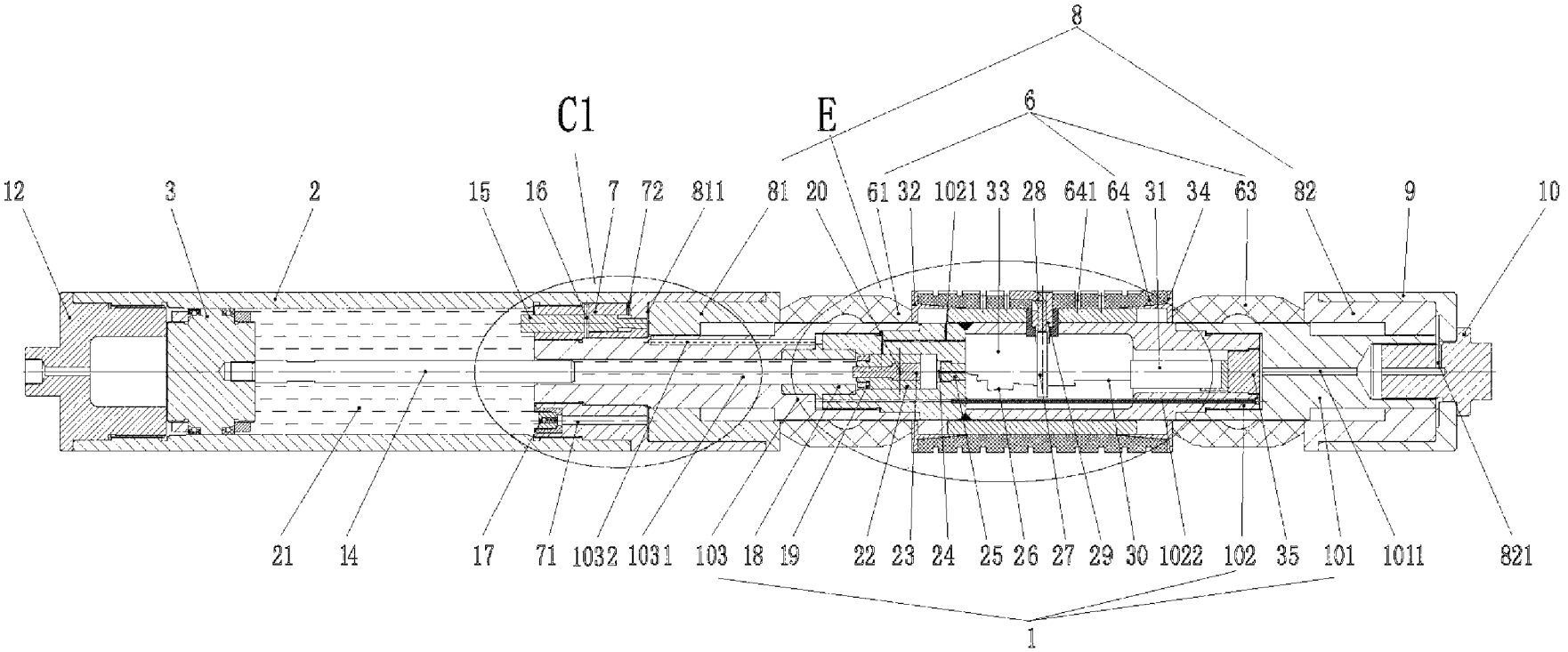
Figure 9A:
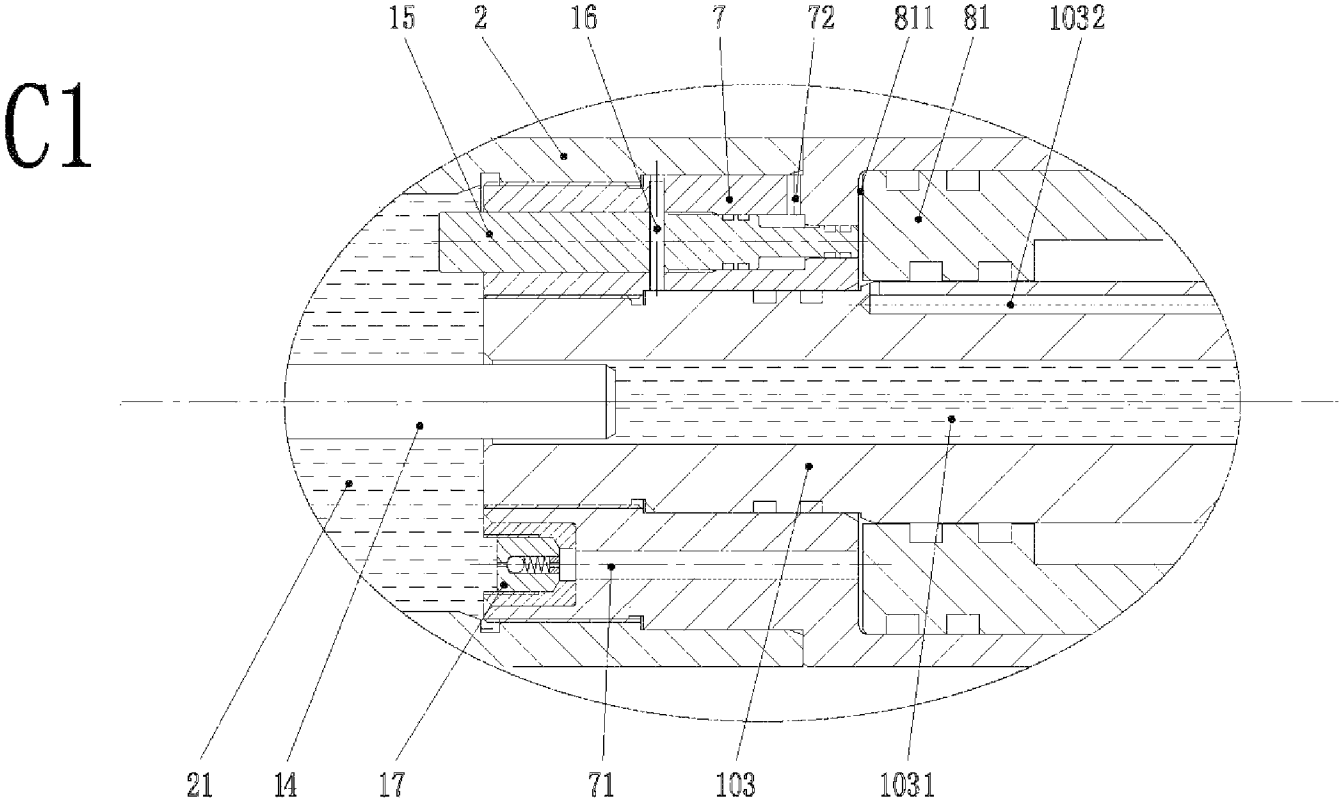
Figure 9B:
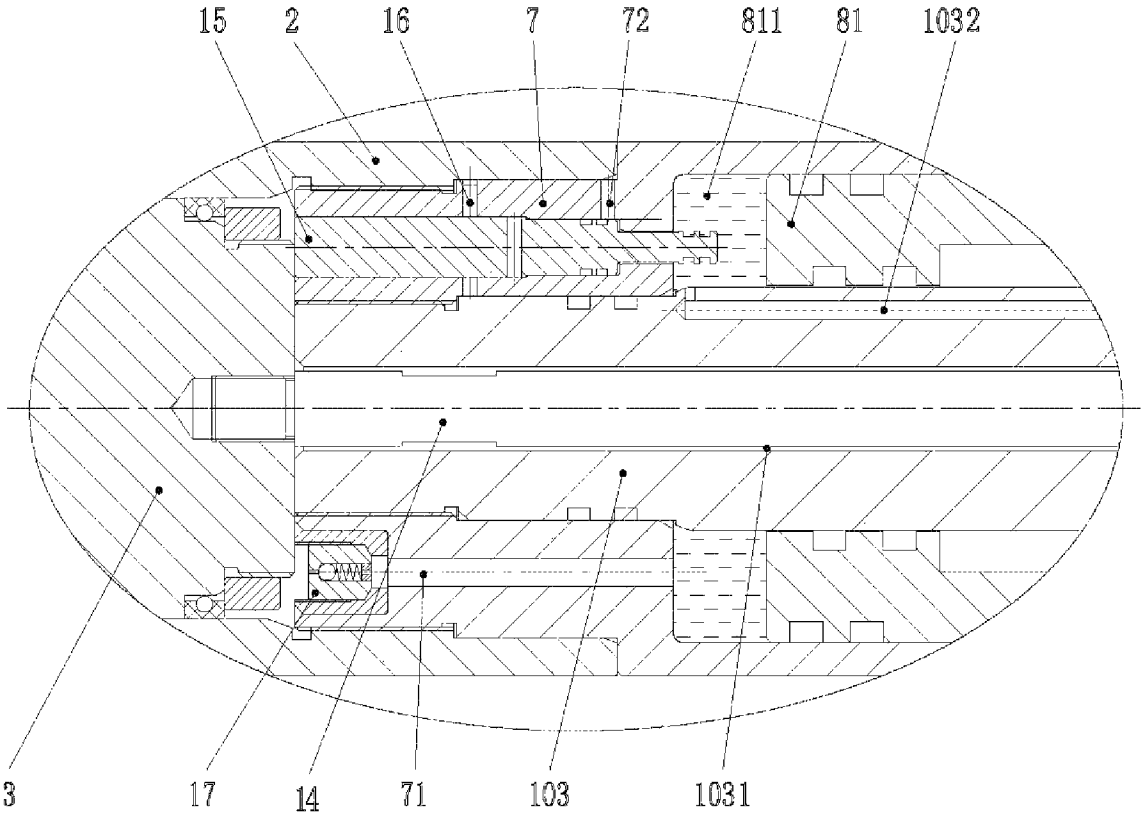
Figure 10:
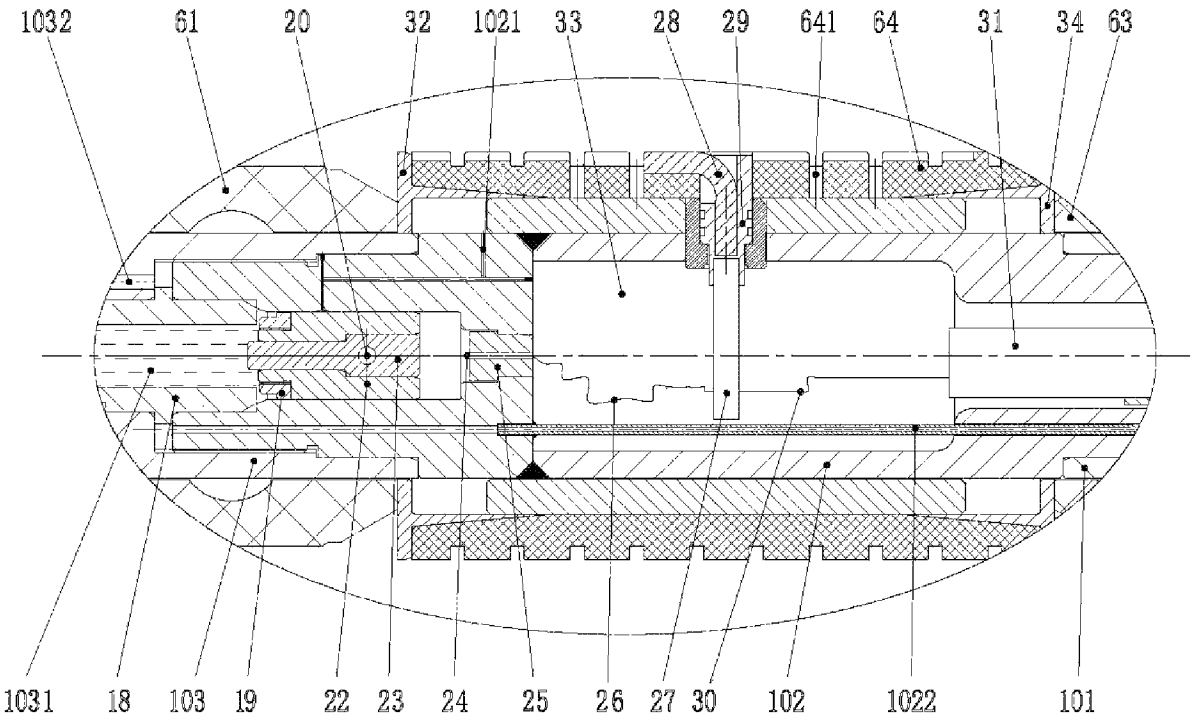
Figure 11:
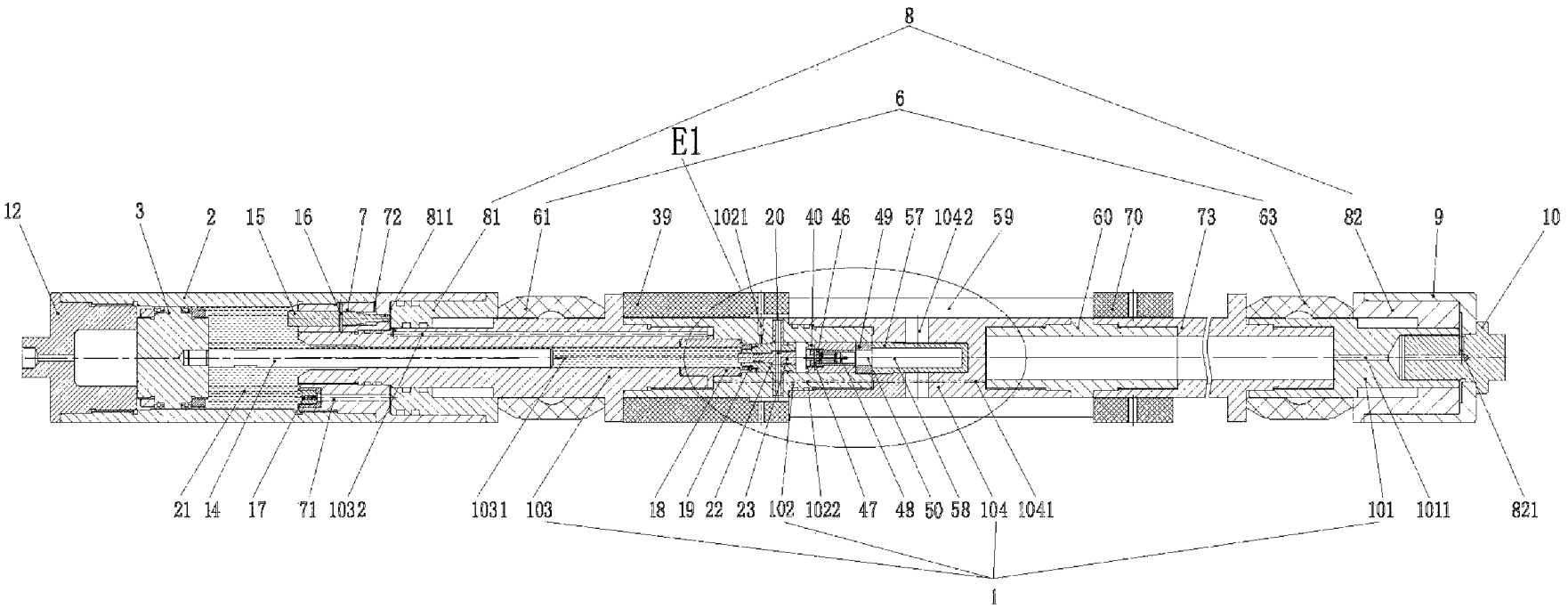
Figure 12:
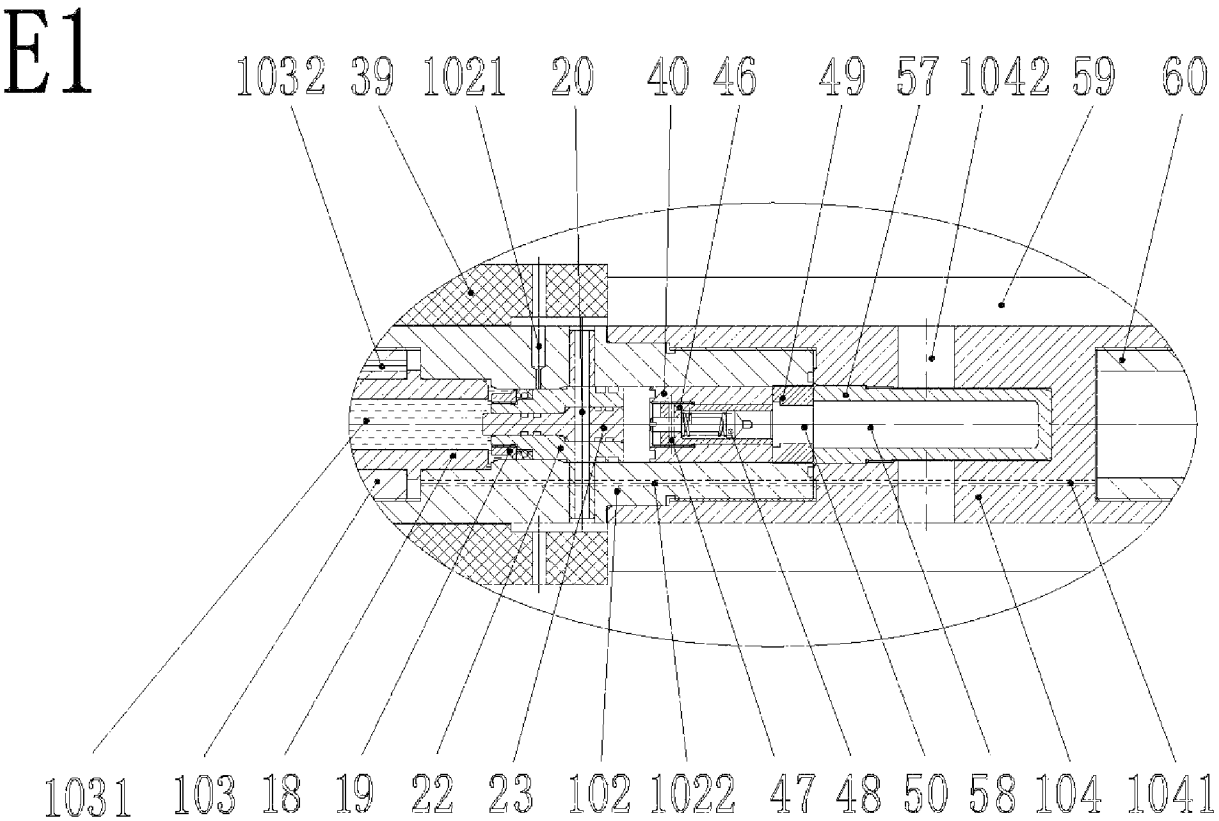

FIG. 8 illustrates a second embodiment of the liquid injection and detonation downhole sub in the current disclosure;

FIG. 9A shows the enlarged section C1 in the downhole sub of FIG. 8;

FIG. 9B shows section C1 when the downhole sub of FIG. 8 is being decompressed;

FIG. 10 shows the enlarged section E in the downhole sub of FIG. 8;

FIG. 11 illustrates a third embodiment of the liquid injection and detonation downhole sub in the current disclosure; and FIG. 12 shows the enlarged section E1 in the downhole sub of FIG. 11.

Table A below lists various components and reference numerals thereof in Embodiment 1 depicted in FIGS. 1-7.

TABLE A

| | |
|---|---|
| Center cylinder assembly 1 | Outer tube 2 |
| Piston 3 | First fluid chamber 121 |
| Second Fluid chamber 21 | First cylinder 101 |
| Coupling 102 | Second cylinder 103 |
| Flow switch 11 | Top connector 12 |
| Check valve 122 | Center channel 1031 |
| First channel 1022 | Fluid injection channel 1021 |
| Third fluid chamber 1011 | Wall 1024 |
| Gap 1023b | Gap 1023a |
| Detonation unit 4 | Cylindrical body 41 |
| Firing pin 42 | Detonation charge 43 |
| Percussion detonator 44 | Shear pins 45 |
| Pressure control module 5 | Housing 51 |
| Ball seat 52 | Ball 53 |
| Pressure spring 54 | Pressure adjusting nut 55 |

TABLE A-continued

| | |
|---|---|
| Internal space 56 | |
| Isolation unit 6 | First elastic sealing ring 61 |
| Support sleeve 62 | Fluid outlet 621 |
| Second elastic sealing ring 63 | Annular coupling 7 |
| Second channel 71 | Axial compression assembly 8 |
| First annular piston 81 | Second annular piston 82 |
| First Gap 811 | Second Gap 821 |
| Guiding head 9 | Compression bolt 10 |
| Well casing 13 | Perforation zone 131 |

Table B below lists various components and reference numerals thereof in Embodiment 2 depicted FIGS. 8-10. Components in the embodiments that are physically or functionally the same are identified using the same reference numerals.

TABLE B

| | |
|---|---|
| Push rod 14 | Metal stem15 |
| First shear pin 16 | Check valve 17 |
| Two-way sealing sleeve 18 | Pressure nut 19 |
| Second shear pin 20 | housing 22 |
| Contact pin 23 | Electric contact terminal 24 |
| Electric contact terminal base 25 | Negative end of electric wire 26 |
| Electric detonator 27 | Detonation cord 28 |
| Detonation cord holder 29 | Positive end of electric wire 30 |
| Power source 31 | First guiding ring 32 |
| Energy release space 33 | Second guiding ring 34 |
| Sealing plug 35 | Rubber bushing 64 |
| Grooves 641 | |

Table C below lists various components and reference numerals thereof in Embodiment 2 depicted FIGS. 11-12. Components in the first, the second, and the third embodiments that are physically or functionally the same share the same reference numerals.

TABLE C

| | |
|---|---|
| First positioning sleeve 39 | |
| Percussion pin fixture 40 | Percussion pin connection sleeve 46 |
| Third shear pin 47 | Spring-loaded percussion pin 48 |
| Percussion firing head base 49 | Percussion firing head 50 |
| Ignition tube 57 | Propellant 58 |
| Solid propellant 59 | Detonation transmission channel 1042 |
| Forth cylinder 104 | Forth fluid injection channel 1041 |
| Cylinder 60 | Right positioning sleeve 70 |
| Fluid bypass channel 72 | Extendable Cylinder 73 |

DETAILED DESCRIPTION OF EMBODIMENTS

It will be appreciated that for simplicity and clarity of illustration, where appropriate, reference numerals have been repeated among the different figures to indicate the functionally identical or similar components. In addition, numerous specific details are set forth in order to provide a thorough understanding of the embodiments described herein, e.g., specific arrangements of channels in the hydraulic system in the embodiment. However, it will be understood by those of ordinary skill in the art that the embodiments described herein can be practiced using variants of the claimed invention, e.g., different arrangements of fluid channels in the hydraulic system.

In other instances, methods, procedures and components have not been described in detail so as not to obscure the relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

When a feature or element is herein referred to as being "on" another feature or element, it can be directly on the other feature or element or intervening features and/or elements may also be present.

Terminology used herein is for the purpose of describing particular embodiments only and is not intended to be limiting of the disclosure. As used herein, the term "and/or" includes any and all combinations of one or more of the associated listed items and may be abbreviated as "/". It should be understood that the "left" and "right" mentioned below are based on the instructions shown in the respective figures. Used herein the term "fluid chamber" generally means a space that holds a fluid, the space can be a fixed space or, it can be expandable into a larger chamber or collapsible into a mere a small gap. Likewise, the term "gap" may refer to a small, fixed space between two adjacent components. It may also be expandable into a fluid chamber when pressurized by fluid in the hydraulic system. The words used for directions are merely for convenience of explanation and do not represent limitations of the technicalities of the invention.

Embodiment 1

As shown in FIG. 1, the fluid injection and denotation downhole sub (or "downhole sub") has a center cylinder assembly 1, an outer tube 2, a piston 3, an ignition unit 4, a pressure control module 5, an isolation unit 6, an annular coupling 7, an axial compression assembly 8, and a guiding head 9. The top connector 12 is at the proximal end of the downhole sub that is closer to the surface. The distal end of the downhole sub, which is further from the surface, has the compression bolt 10. In this disclosure the proximal end of a component in the device is from time to time referred to as the "left end" while the distal end of the component is referred to as the "right end," which are their positions shown in the drawings.

The center cylinder assembly 1 and the outer tube 2 are connected at the annular coupling 7. The distal end of the outer tube 2 sleeves over the proximal end of the annular coupling 7 while the distal portion of the annular coupling 7 sleeves over the first annular piston 81. While the proximal end of the center cylinder assembly 1 extends through the full length of the annular coupling 7.

Figure 4:
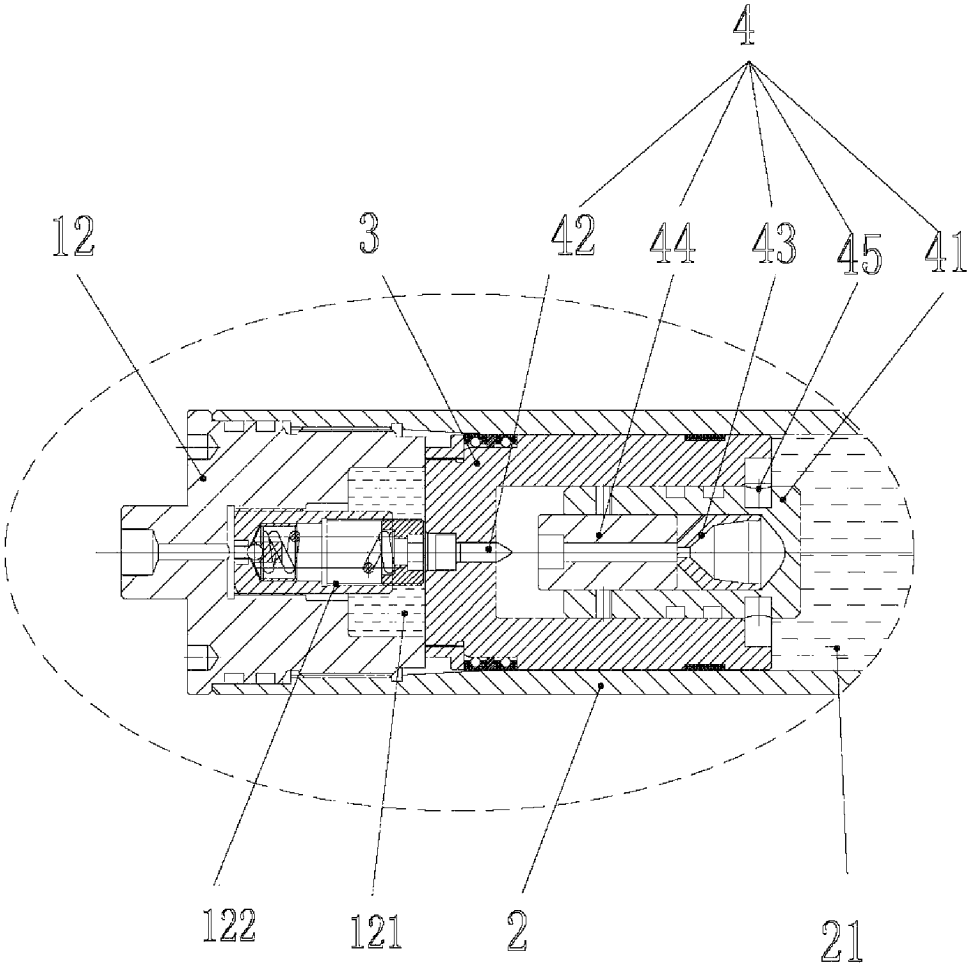
FIG. 4 shows the enlarged section B in the downhole sub of FIG. 1.

Referring to FIGS. 1 and 4, the piston 3 and the ignition unit 4 are disposed about the proximal end of the downhole sub. Specifically, the piston 3 is movably disposed inside the outer tube 2. In this embodiment, the ignition unit is affixed to the piston 3 by a pair of shear pins 45. The distal end of the ignition unit 4 extends out from the distal end of the piston 3. The firing pin 42 is disposed at the proximal end of the ignition unit while the detonation charge 43 is to the distal end. The detonator 44 is connected to the detonation charge 43, disposed away from the firing pin 42. During operation, when the distal end of the cylindrical body 41 is pushed against the second cylinder 103, severing the shear pins 45 and allowing the detonator 44 to be pushed toward the firing pin 42. Collision between the firing pin 42 and the detonator 44 ignites the detonation charge 43.

Figure 3:
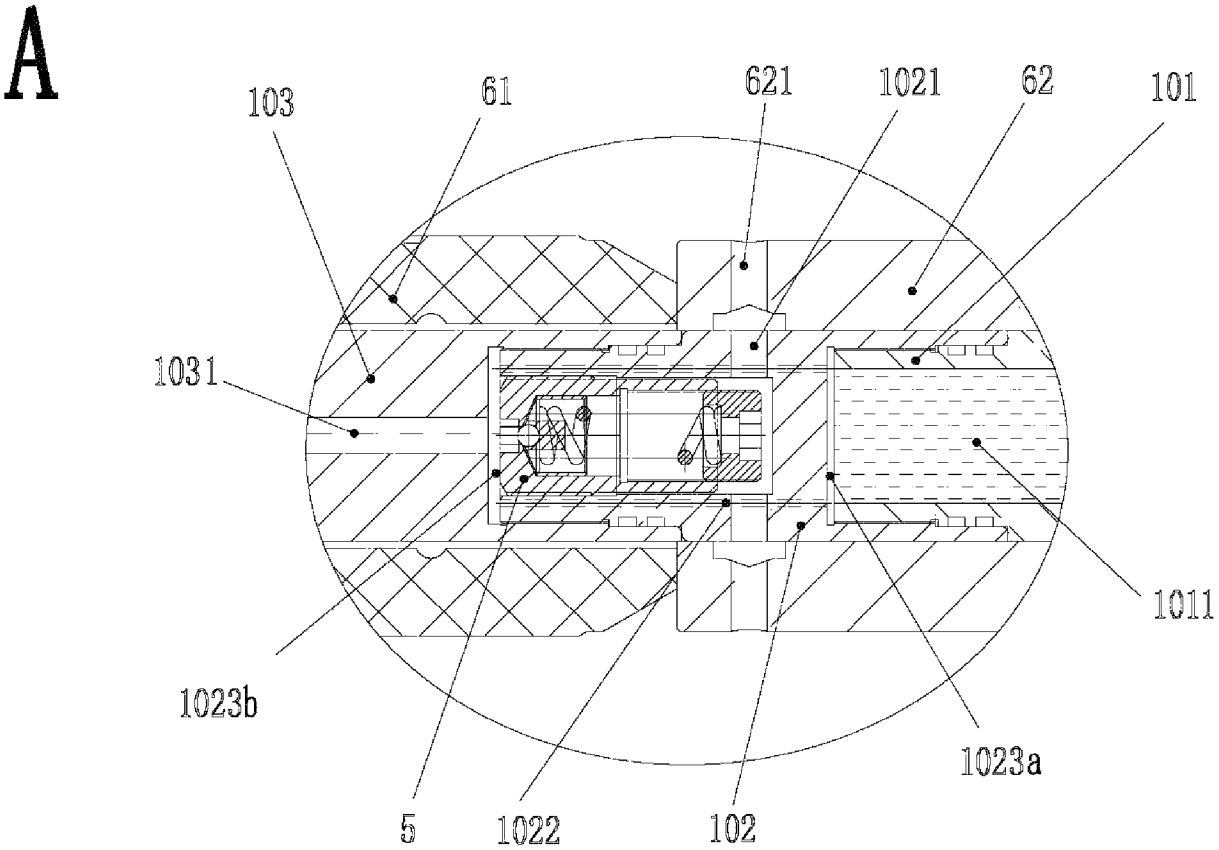
FIG. 3 shows the enlarged section A in the downhole sub in FIG. 1.

Referring to FIG. 1 and FIG. 3, the center cylinder assembly 1 includes the first cylinder 101, the second cylinder 103, and the coupling 102 disposed between the first cylinder 101 and the second cylinder 103. The isolation unit 6 includes a first elastic sealing ring 61, a support sleeve 62, and a second elastic sealing ring 63. The axial compression assembly 8 has a first annular piston 81 abutting the first elastic sealing ring 61 and a second annular piston 82 abutting the second elastic sealing ring 63. The support sleeve 62 is disposed between the two elastic sealing rings 61 and 63. The center cylinder assembly 1 further includes a guiding head 9 affixed to its distal end by a compression bolt 10.

Figure 2:
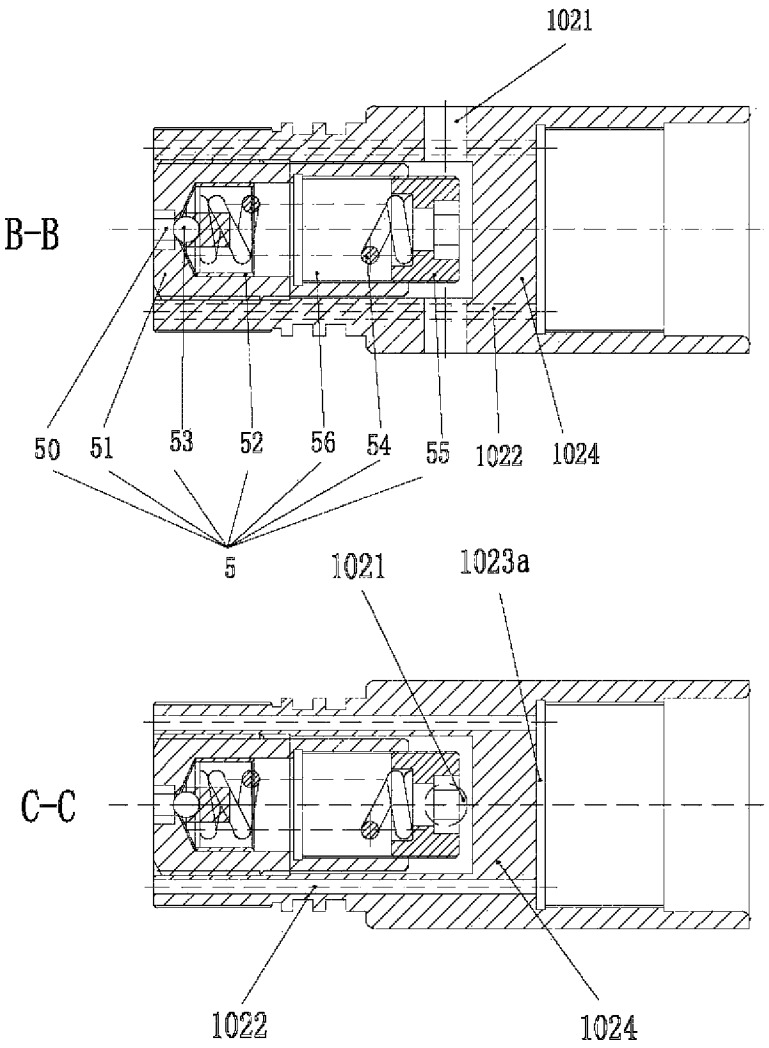
FIG. 2 shows an embodiment of the pressure control module of the downhole sub in FIG. 1.
Figure 2:
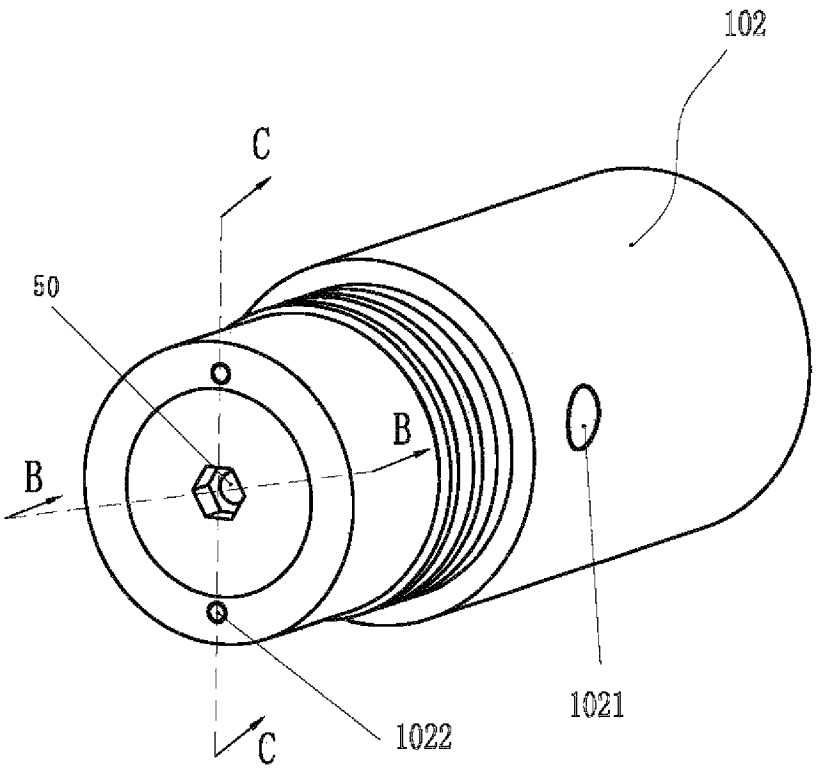

FIG. 2 shows three views of the assembly having the coupling 102 and the pressure control module 5, which are respectively the perspective view, the sectional view along the B-B direction, and the sectional view along the C-C direction. The coupling 102 is separated into a first tubular portion on the left and a second tubular portion on the right by a wall 1024. In this embodiment, the pressure control module 5, which has a spring-loaded check valve, resides in the first tubular portion. The pressure control module 5 has a housing 51 with an internal space 56, a ball seat 52, a pressure ball 53, a pressure spring 54, and a pressure adjustment nut 55. The ball seat 52 is disposed inside the housing 51 on the left side while the pressure adjustment nut 55 is disposed inside the housing 51 on the right side. The pressure ball 53 is placed at the left end of ball seat 52 and abuts tightly against the inlet 50 to the housing. The pressure spring 54 is placed between the ball seat 52 and the pressure adjustment nut 55. The pressure control module 5 is in a normally closed position as the pressure ball 53 blocks the inlet 50. When the pressure exerted on the spring 54 exceeds a certain preset value, the pressure ball 53 and spring 54 are compressed, opening the inlet 50. The pressure adjustment nut 55 adjusts the tension in the spring 54, effectively setting the pressure at which the inlet is open or blocked.

The fluid injection channel 1021 extends through the wall of the first tubular section of the coupling 102 in the radial direction. A pair of first channels 1022 extend through the wall 1024 of the first tubular section of the coupling 102 in axial direction so that the first channels 1022 open into the second tubular portion.

As shown in FIG. 3, the second tubular portion receives a portion of the proximal end of the first cylinder 101. The hollow center of the first cylinder 101 serves as the third fluid chamber 1011. The space between the wall 1024 in the coupling 102 and the proximal end of the first cylinder 101 is the gap 1023*a*. The space between the left end of the coupling 102 and the second cylinder 103 is the gap 1023*b*. Note that first channels 1022 fluidly connect the gap 1023*a* with the gap 1023*b*. The fluid injection channel 1021 and first channels 1022 are not connected, i.e., channel 1021 and first channel 1022 are separated from one other. The presence of 1023*a* and 1023*b* prevent the first channels 1022 from being blocked. Further, fluid outlet 621 are two fluid channels disposed in the radial direction in the support sleeve 62, which are aligned with fluid injection channels 1021.

FIG. 6 illustrates the status of the downhole sub when filled with the liquid energetic material. The second fluid chamber 21 is the space defined by the outer tube 2, the piston 3, the proximal end of the second cylinder 103, and the proximal end of the annular coupling 7. During operation, the second fluid chamber 21 is first filled with a liquid energetic material. The third fluid chamber 1011, which is the hollow center of the first cylinder 101, is filled with a hydraulic fluid. Once filled, the downhole sub is lowered into the placed in the well to a pre-determined zone.

During operation, the top connector 12 is connected with a driving unit (not shown), e.g., a hydraulic pump. The space defined by top connector 12, the outer tube 2, and the piston 3 is the first fluid chamber 121, which stores the hydraulic fluid injected by the driving unit through the check valve 122 in the top connector 12.

Figure 5:
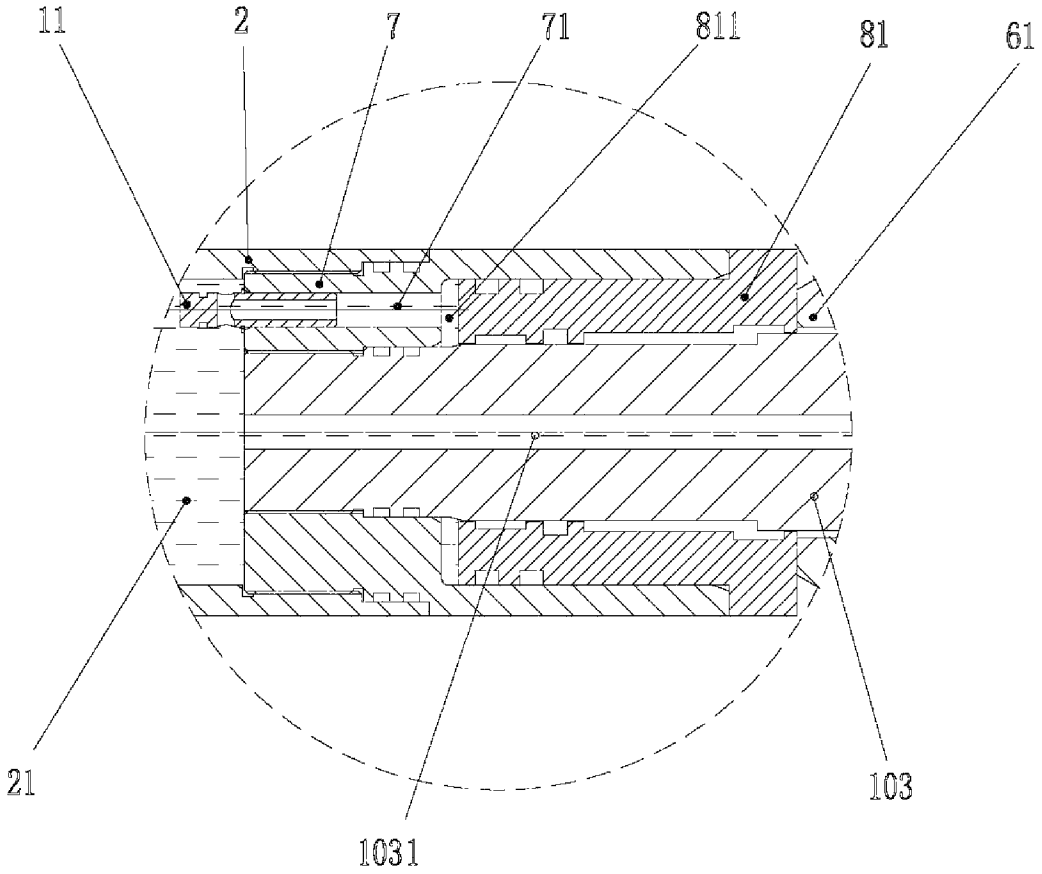
FIG. 5 shows the enlarged section C in the downhole sub of FIG. 1.

After the downhole sub is lowered to the desired location in the well, the hydraulic fluid from the driving unit is injected into the first fluid chamber 121, thereby pushing the piston 3 to the right, which in turn pushes the liquid energetic material in the second fluid chamber 21 through the flow switch 11 and the second channel 71 into the first gap 811, shown in FIG. 5.

The pressure exerted by the liquid energetic material on the first annular piston 81 pushes it to the right. At the same time, the liquid energetic material in second fluid chamber 21 also flows through the center channel 1031 in second cylinder 103, the first channels 1022, into the gap 1023*a*, and from there into the third fluid chamber 1011. The volume of liquid in the third fluid chamber 1011 therefore expands, elevating the pressure of the hydraulic fluid therein. As a result, the hydraulic fluid flows from third fluid chamber 1011 through the second gap 821 and pushes the second annular piston 82 to the left. Consequently, the first annular piston 81 and the second annular piston 82 push the first elastic sealing ring 61 and the second elastic sealing ring 63, respectively, toward the support sleeve 62. When compressed in the axial direction, the first elastic sealing ring 61 and the second elastic sealing ring 63 expand radially against the well casing 13. As shown in FIG. 7, expansion of the elastic sealing rings 61 and 63 isolates the section of the well casing 13 between the two elastic sealing rings 61 and 63. This section of well casing contains a plurality of perforations and is referred to as the perforation zone 131 on the well casing 13 (FIG. 7).

Note that isolation of the perforation zone 131 occurs when injection of hydraulic fluid gradually pressurizes the hydraulic fluid as well as the liquid energetic material in the downhole sub. However, before the pressure of the liquid energetic material exceeds the pressure of the pressure control module 5, even if the elastic sealing rings 61 and 63 start expanding in the radial direction, the pressure control module 5 remains closed so that no liquid energetic material enters the perforation zone.

In another aspect, the deformation of the elastic sealing rings 61 and 63 gradually increases resistance and elevates the pressure of the liquid energetic material in the second fluid chamber 21. Referring again to FIGS. 3 and 7, the liquid energetic material in the center channel 1031 exerts pressure against the pressure ball 53. When the pressure is greater than the pressure set by the pressure spring 54 in the pressure control module 5, the liquid energetic material pushes the pressure ball 53 away from the inlet 50, fills the internal chamber 56, and exits from the outlet in the pressure adjustment nut 55 into the fluid injection channels 1021 and fluid outlets 621. The liquid energetic material then enters the sealed perforation zone 131 and through the plurality of perforations in the well casing into the subterranean formation. In this manner, the liquid energetic material in the second fluid chamber 21 is injected into the subterranean formation.

Referring to FIGS. 5 and 7, after the liquid energetic material in second fluid chamber 21 is injected into the subterranean formation, the distal end of the piston 3 presses against flow switch 11 into the second channel 71. Thus, the liquid energetic material between flow switch 11 and first annular piston 81 are completely separated from the liquid energetic material in second fluid chamber 21.

In addition, after the flow switch 11 is pushed into second channel 71, the ignition unit 4, carried by piston 3, pushes against the proximal end of second cylinder 103. This movement severs the shear pins 45 that restrain the cylindrical body 41. Consequently, the cylindrical body 41 (carrying detonation charge 43) moves to the left together with piston 3 until the percussion detonator 44 collides with the firing pin 42. The percussion detonator 44 ignites the detonation charge 43. The detonation produces a high-speed jet that penetrates the wall at right end of cylindrical body 41, further igniting the liquid energetic material in the center channel 1031 in the second cylinder 103. The remaining liquid energetic material in the liquid injection channels and the perforation zone 131 in the downhole sub acts as a detonation transmitter, ignites the liquid energetic material in the subterranean formation, thereby causing a series of controlled explosions and fracturing in the subterranean formation surrounding the well.

In one preferred embodiment, the perforation zone 131 is isolated by the elastic sealing rings 61 and 63 prior to being filled with liquid energetic material so that the liquid energetic material is injected into the formation at the desired zone. Further, the ignition unit is activated when the liquid energetic material is driven out from the second fluid chamber 21. In this respect, a certain amount of the liquid energetic material enters the third fluid chamber 1011 to compensate for the hydraulic liquid utilized for isolating the perforation zone.

Explosive fracturing in hydrocarbon reservoir layers is a dynamic process. Under the shock load effects at certain loading speed, a network of fractures is formed in the formation, which greatly increases the volumetric fracture density of the reservoir. The explosion shockwave, the stress wave, and the large amount of high-pressure gas generated by the explosion cause the fractures to further expand and extend. In the meantime, the formation layer is torn, staggered, and twisted and having the support of gravels, the fractures will not be able to resume in-situ closure after the shock-load is discharged. This create fractures with higher permeability. At the same time, the reservoir will experience irreversible plastic deformation under the high pressure exceeding its yield strength limit. As such, the fractures will maintain a certain slit width after the shock wave pressure is discharged.

As shown in Table D, the preliminary test using the downhole sub of FIG. 1 shows that fracturing using a liquid explosive is evidently more efficient than hydraulic fracturing. Liquid explosive fracturing can greatly increase the drainage area of in the formation and enhance the communication between the wellbore and the formation. This significantly increases the oil and gas reservoir recovery rate and the production of a well.

TABLE D

| Item | Performance | Performance of this invention compared to traditional hydraulic fracturing (under the same hydrocarbon reservoir conditions) |
|---|---|---|
| 1 | Production | Increased 2-8 times |
| 2 | Recovery Rate | Increased 1-3 times |

TABLE D-continued

| Item | Performance | Performance of this invention compared to traditional hydraulic fracturing (under the same hydrocarbon reservoir conditions) |
|---|---|---|
| 3 | Water Consumption | Reduced by approximately 99% |
| 4 | Proppant (Sand) Consumption | This method does not require proppant |
| 5 | Cost of Reservoir Stimulation | Reduced by approximately 50% |
| 6 | Equipment Requirements | Does not require large-scaled equipment for operation |
| 7 | Geographical Conditions | The device of this invention is 1-10 tons (2,200-22,000 lb.) It is small in size and convenient for transportation in any geographical environments. |

Embodiment 2

FIGS. 8-10 show Embodiment 2 of the downhole sub in this disclosure. Embodiment 2 uses piston 3 to push liquid energetic material in the second fluid chamber 21 against the first annular piston 81 so it moves to the right as well as against the second annular piston 82 so it moves to the left, thereby compressing sealing rings 61 and 63, respectively. Differing from Embodiment 1, which employs a hydraulic fluid in the third fluid chamber 1011, Embodiment 2 uses the liquid energetic material as the hydraulic fluid to pressurize the second elastic sealing ring.

Specifically, during operation, the hydraulic fluid is injected through the top connector 12 against piston 3, which moves toward right and pressurizes the liquid energetic material in the second fluid chamber 21. Referring to FIG. 9A, the pressurized liquid energetic material pushes open the check valve 17, allowing the liquid energetic material in the second fluid chamber 21 to be injected into the gap 811, thereby pushing the first annual piston 81 against the first elastic sealing ring 61. Simultaneously, the pressurized liquid energetic material flows through channels 1032, 1022, 1011, as well as channels in the compression bolt 10, filling the gap 821 so as to push the second annual piston 82 against the second elastic sealing ring 63.

The first elastic sealing ring 61 and the second elastic sealing ring 63 in turn push against the rubber bushing 64 through the first guiding ring 32 and the second guiding ring 34, respectively. As such, the first elastic sealing ring 61 and the second elastic sealing ring 63 are compressed axially and expand radially against the well casing, sealing off the perforation zone in the well casing from the rest in the well casing.

As shown in FIG. 10, the rubber bushing 64, two guiding rings 32 and 34, and the outer surface of coupling define a holding space for liquid energetic material during operation. The rubber bushing 64 has a plurality of grooves 641 on its surface. The grooves 641 are aligned with channels in the rubber bushing 64 so that liquid energetic material may flow from the holding space through the rubber bushing 64 into the grooves and from there through perforations in the well casing (not shown) being injected into the subterranean formation. Compared with FIG. 7, the rubber bushing 64 in second embodiment is functionally equivalent to the support sleeve 62 in first embodiment but distributes fluid evenly and faster due to the multiple grooves on the rubber bushing 64.

Further differing from Embodiment 1, Embodiment 2 adopts an electric detonator 27 rather than the percussion detonator 44. The ignition unit includes a contact pin 23, an electric contact terminal 24 disposed inside a seat 25, which is connected to the detonator 27 through a wire 26. The detonator 27 is connected to a power source, e.g., a battery 31, via wire 30. The contact pin 23 is affixed in place by a shear pin 20.

Piston 3 is connected to a push rod 14 (see FIGS. 8 and 9A). As the push rod 14 moves rightward with the piston 3 inside the center channel 1031, it comes into contact with the right end of the contact pin 23 and its housing 22, eventually breaking the shear pin 20 and pushing the contact pin 23 and housing 22 toward the contact terminal 24.

The dislocation of the contact pin 23 and housing 22 serves several functions. First, it opens up the fluid passage between the center channel 1031 and channel 1021. Consequently, the pressurized liquid energetic material can flow from 21 through 1031 to 1021 into the holding space under the rubber bushing 64 and from there through grooves 641 being injected into the formation through perforations in the well casing (not shown). Second, when the contact pin 23 contacts the contact terminal 24, it closes the circuit between the anode and the cathode of the power supply 31 so that the detonator 27 and detonation cord 28 are ignited, in turn igniting the liquid energetic material between the rubber bushing 64 and the well casing (not shows) and subsequently the liquid energetic material in the formation.

In another aspect of this embodiment, since the elastic rubber rings 61 and 63 are compressed and pushed against the well casing during liquid energetic material injection and detonation, they need to be decompressed before the downhole sub can disengage from the well casing and be retrieved from the well. The decompression is accomplished by releasing the liquid energetic material compressing the elastic rubber rings 61 and 63 through a pressure relief device and a bypass channel 72.

Referring to FIGS. 8 and 9, the pressure relief device includes a stem 15 affixed inside its housing 7 by a shear pin 16. Prior to decompression, the left end of the stem 15 is extended into the second fluid channel 21 while its right end has one or more O-rings, which seal the passage between the bypass channel 72 and gap 811. Referring to FIG. 9B, at the end of the injection step, the piston 3 at the end of its rightward travel pushes the stem 15 further into the housing 7 by breaking the shear pin 16. Consequently, the right end of the stem 15, together with its O-ring seal, extends into gap 811. Note that gap 811 now is filled with liquid energetic material, which pressurizes the first annual piston 81. On the other hand, since the O-rings seal is pushed out from the housing 7, liquid energetic material in gap 811 can leak through the housing 7, the bypass channel 72, and the gap between cylinder bodies into the well casing. Since gap 811 and gap 821 are fluidly connected, liquid energetic material in gap 821 also flows back to gap 811 during decompression and is further released from there through the bypass channel 72.

In one aspect of this embodiment, the ignition is timed immediately prior to the step of decompression. The timing can be adjusted by the length of the push rod 14 in that the piston 13 pushes stem 15 in just prior to the contact pin 23 is pushed to contact the contact terminal 24.

Embodiment 3

FIGS. 10 and 11 illustrate Embodiment 3. The liquid energetic material injection mechanism and its operation are similar to Embodiments 1 and 2. On the other hand, the ignition unit in Embodiment 3 does not employ a detonator. Instead, the ignition unit have a sleeve 46, a shear pin 47, a spring-loaded percussion pin 48, and a percussion firing head 50 installed in the seat 49 of the firing head. The contact pin 23, pushed by the push rod 14, breaks the shear pin 47 to release the spring-loaded percussion pin 48, which hits and ignites the firing head 50. The ignition of firing head ignites propellant 58 packed in ignition tube 57. The ignition of propellant 58 melts the tube 57 so that the hot material spreads out through channel 1042 and further ignites the solid propellant sleeve 59 disposed around cylinder 104. The subsequent explosion of the solid propellant further ignites the liquid energetic material already injected in the formation.

In addition, instead of being pushed against the support sleeve 62 as in Embodiment 1 or the rubber bushing 64 as in Embodiment 2, the elastic sealing rings 61 and 63 are compressed against two lips on the cylinder. Between the sealing rings 61 and 63 there are the solid propellant sleeve 59 held in place by the left positioning sleeve 39 and the right positioning sleeve 70.

In Embodiment 3, channels are disposed in positioning sleeves 39 and 70, providing a passage for the liquid energetic material to flow into the well casing. Further, by using a combination of the solid propellant sleeve 59 and positioning sleeve 39 and 70, the length of the solid propellant sleeve 59 can be adjusted according to the desired loading of solid propellant. When a larger amount of solid propellant is required, the positioning sleeves 30 and 70 can be shortened or eliminated. In that case, fluid channels can be opened in the solid propellant sleeve 59.

In this disclosure, the liquid energetic material is a liquid with a high amount of stored chemical energy that can be released upon ignition, including a liquid explosive, a liquid propellant, a liquid fuel, etc.

The liquid explosive can be one or more of compounds selected from acetyl nitrate, ascaridole, astrolite, 1,2,4-B utanetriol trinitrate, diacetyl peroxide, dichloroacetylene, diethyl ether peroxide, diethylene glycol dinitrate, ethyl azide, ethylene glycol dinitrate, hydrogen peroxide, isopropyl nitrate, methyl ethyl ketone peroxide, methyl nitrate, nitroethane, nitrogen trichloride, nitroglycerin, nitromethane, panclastite, peroxymonosulfuric acid, picatinny liquid explosive, propylene glycol dinitrate, tetranitromethane, triethylene glycol dinitrate, trimethylolethane trinitrate, and 2,4,6-trinitrobenzenesulfonic acid.

The above embodiments illustrate some of the applications of the present disclosure. Additional embodiments and variations thereof are numerous. For example, the device can be modified by removing the ignition unit or removing the detonation charge from the ignition unit. After such modification, the device can be deployed to inject any solid-free fluid, e.g., completion fluid, into a formation at a certain zone in the well. The device and method of this disclosure can be applied to both vertical well and directional well.

I claim:

1. A downhole sub for oil or gas exploration, comprising:

a cylindrical body and a sealing device disposed about the cylindrical body, wherein the cylindrical body comprises a first fluid chamber configured to store a hydraulic fluid, a second fluid chamber configured to store a liquid energetic material, a piston slidably disposed between the first fluid chamber and the second fluid chamber, and an ignition unit adjacent to the second fluid chamber, wherein the sealing device comprises a first annular piston, a first annular sealing ring, a second annular sealing ring, and a second annular piston arranged in tandem along an axial direction of the cylindrical body.

2. The downhole sub of claim 1, wherein the second fluid chamber is fluidly connected to the first annular piston and the third fluid chamber is fluidly connected to the second annular piston.

3. The downhole sub of claim 2, wherein the ignition unit is a percussion firing unit comprising a firing pin and an ignition source.

4. The downhole sub of claim 2, wherein the ignition unit is an electric ignition unit comprising an electric detonator and a power source.

5. The downhole sub of claim 1, wherein the first annular sealing ring and the second annular sealing ring are expandable in a radial direction of the downhole sub.

6. The downhole sub of claim 5, wherein, during operation, the piston exerts a pressure on the liquid energetic material in the second fluid chamber, and causes the pressurized liquid energetic material to push the first annular piston toward the first annular sealing ring and to push the second annular piston toward the second annular sealing ring, whereby causing the first annular sealing ring and the second annular sealing ring to expand radially.

7. The downhole sub of claim 4, further comprising one or more stopping mechanisms disposed between the first annular sealing ring and the second annular sealing ring, wherein the stopping mechanism is a protrusion extending radially from a surface of the cylindrical body.

8. The downhole sub of claim 4, further comprising a sleeve having one or more orifices or channels fluidly connected to the second fluid chamber.

9. The downhole sub of claim 7, wherein the sleeve is made of metal, rubber, or a solid propellant.

10. The downhole sub of claim 1, wherein the piston is connected to a rod configured to move with the piston and to stop after coming into contact with the ignition unit.

11. The downhole sub of claim 9, wherein the ignition unit is activated by the rod.

12. The downhole sub of claim 1, further comprising an annular coupling disposed between the second fluid chamber and the first annular piston, wherein the coupling houses a spring-loaded check valve having an inlet opening to the second fluid chamber and an outlet opening toward the first annular piston.

13. The downhole sub of claim 12, further comprising a pressure relief device disposed about the coupling, wherein the pressure relief device has an inlet opening toward the first annular piston and an outlet opening toward a gap in the cylindrical body.

14. A method for injecting and igniting a liquid energetic material in a subterranean formation, comprising:

loading a liquid energetic material into the downhole sub of claim 1;

lowering the downhole sub into a well casing installed in the subterranean formation;

sealing a section of the well casing having a plurality of perforations using the sealing device of the downhole sub;

injecting the liquid energetic material in the downhole sub into the subterranean formation through the plurality of perforations in the well casing; and igniting the liquid energetic material in the subterranean formation using the ignition unit in the downhole sub.

15. The method of claim 14, wherein the sealing step comprises:

hydraulically pressurizing the liquid energetic material in the second fluid chamber;

hydraulically pushing the first annular piston toward the first annular sealing ring, hydraulically pushing the second annular piston toward the second annular sealing ring, wherein the compressed first annular sealing ring and the compressed second annular sealing ring expand in a radial direction of the downhole sub toward an inner surface of the well casing.

16. The method of claim 14, wherein the injecting step further comprises:

opening one or more channels connecting the second fluid chamber to one or more openings on the surface of the downhole sub aligned with the sealed section of the well casing.

17. The method of claim 14, wherein the ignition unit comprises a percussion firing pin and a firing head, wherein the ignition step comprising: hydraulically pushing the piston toward the ignition unit; contacting the ignition unit by the piston or an extension thereof; and dislodging the percussion firing pin to collide with the firing head to ignite.

18. The method of claim 14, wherein the ignition unit is an electric ignition unit comprising an electric detonator and a power source, wherein the detonating step comprising:

hydraulically pushing the piston toward the ignition unit; the ignition unit with the piston or an extension thereof, and electrically connecting the electric detonator and the power source to ignite the electric detonator.

19. The method of claim 14, further comprising decompressing the downhole sub to disengaging the first annular sealing ring and the second sealing ring from the well casing; and retrieving the downhole sub from the well casing.

20. The method of claim 19, wherein decompressing the downhole sub comprises pushing a pressure relief device by the piston or an extension thereof to open a fluid passage between the well casing and the first annular piston.

* * * * *